US010863827B1

(12) United States Patent
Marowitz

(10) Patent No.: US 10,863,827 B1
(45) Date of Patent: Dec. 15, 2020

(54) BACK SUPPORT

(71) Applicant: Johanna Marowitz, Encino, CA (US)

(72) Inventor: Johanna Marowitz, Encino, CA (US)

( * ) Notice: Subject to any disclaimer, the term of this patent is extended or adjusted under 35 U.S.C. 154(b) by 0 days.

(21) Appl. No.: 16/255,867

(22) Filed: Jan. 24, 2019

Related U.S. Application Data

(60) Provisional application No. 62/709,630, filed on Jan. 24, 2018.

(51) Int. Cl.
*A47C 7/42* (2006.01)
*A47C 3/38* (2006.01)

(52) U.S. Cl.
CPC ..... *A47C 7/425* (2013.01); *A47C 3/38* (2013.01)

(58) Field of Classification Search
CPC ..... A47C 7/425; A47C 7/42; A47C 7/383; A47C 7/386; A47G 2009/1018
See application file for complete search history.

(56) References Cited

U.S. PATENT DOCUMENTS 1,386,652 A * 8/1921 Patton ..... A47G 9/10 5/640
3,195,953 A * 7/1965 Zacks ..... B60N 2/882 297/397
3,604,026 A * 9/1971 Scheips ..... A47C 7/383 297/397
4,853,994 A * 8/1989 Ekstein ..... A47G 9/1045 5/639
4,951,998 A * 8/1990 McClain ..... B60N 2/882 297/395
5,228,158 A * 7/1993 Park ..... A47G 9/10 5/636
5,297,848 A * 3/1994 Grinnell ..... A47C 7/029 297/219.1
5,503,456 A * 4/1996 Rossini ..... A47C 7/383 224/584
5,544,378 A * 8/1996 Chow ..... A47C 7/383 297/397
6,575,533 B1 * 6/2003 Kicos ..... A47C 7/383 297/188.06
6,684,429 B1 * 2/2004 Deering ..... A47C 7/383 5/636

(Continued)

FOREIGN PATENT DOCUMENTS

CH 92536 A * 1/1922 ..... A47C 7/383
DE 102008003508 A1 * 7/2009 ..... A47C 7/383

(Continued)

*Primary Examiner* — Timothy J Brindley
(74) *Attorney, Agent, or Firm* — Matthew M. Googe; Robinson IP Law, PLLC

(57) ABSTRACT

A portable and foldable back support includes: a foam cushion; a cover shaped to tightly fit around the foam cushion, the cover including a front surface, a rear surface opposite the front surface, and a casing attached to the rear surface of the cover, the casing extending across a width of the rear surface and including a channel formed therethrough; an elongate string shaped to fit through and secured to the casing, the elongate string including opposing ends. In an unfolded configuration the string is untied, and the foam cushion is expanded within the cover. In a folded configuration the opposing ends of the string are tied together such that the cover and encased foam cushion are folded.

4 Claims, 5 Drawing Sheets

(56) References Cited

U.S. PATENT DOCUMENTS

| | | | | |
|---|---|---|---|---|
| 8,327,483 | B1 * | 12/2012 | Zamora | A47G 9/10 5/636 |
| 8,468,627 | B2 * | 6/2013 | Leach | A47C 20/021 5/630 |
| D746,080 | S * | 12/2015 | Mittelstadt | D6/601 |
| 10,076,190 | B2 * | 9/2018 | Atkinson | A47C 7/383 |
| 2011/0017793 | A1 * | 1/2011 | Mellion | A45F 3/02 224/610 |
| 2015/0351564 | A1 * | 12/2015 | Vogel | A47G 9/1081 5/640 |
| 2016/0100689 | A1 * | 4/2016 | Wang | A47C 7/021 5/653 |
| 2016/0324323 | A1 * | 11/2016 | Jahner | A47C 7/425 |
| 2019/0200773 | A1 * | 7/2019 | Komsky | A47C 7/383 |
| 2019/0388267 | A1 * | 12/2019 | Bhaskaran | A47C 7/46 |
| 2020/0128981 | A1 * | 4/2020 | Yu | A47C 7/46 |
| 2020/0237123 | A1 * | 7/2020 | Yu | A47G 9/1081 |

FOREIGN PATENT DOCUMENTS

| | | | | |
|---|---|---|---|---|
| DE | 202011108163 | U * | 1/2012 | A47C 7/383 |
| DE | 102018009266 | A1 * | 5/2019 | B60N 2/882 |
| FR | 1417332 | A * | 11/1965 | A47C 7/383 |
| GB | 758091 | A * | 9/1956 | A47C 7/383 |

* cited by examiner

BACK SUPPORT

CROSS-REFERENCE TO RELATED APPLICATION

This application claims priority to and is a non provisional of U.S. Provisional Patent Application Ser. No. 62/709,630 for a Back Support filed on Jan. 24, 2018, the contents of which are incorporated by reference in its entirety.

FIELD

This disclosure relates to the field of back supports. More particularly, this disclosure relates to a portable and foldable backrest.

BACKGROUND

Currently there are a number of solutions for back support. Some of these solutions attempt structural viability, but these solutions fail to meet the needs of the industry because of an inadequate level of ease. Other solutions suggest modification, but these solutions are similarly unable to meet the needs of the industry because they are awkward and not durable. Still other solutions seek to address constancy, but these solutions also fail to meet the industry needs because of restrictive resources that are ill-chosen and time consuming.

It would be desirable to have a portable, compact back support cushion, for on the go travels, that helps relieve the pain from the curvature exposed by a sway back against a hard backed seating surface. The components of back supports do not encompass the targeted areas of pain exposed by the alignment of a sway back. Furthermore, it would also be desirable to have a compact cushion for immediate use on hard backed seating surface. Still further, it would be desirable to have temporary comfort for various personal and/or professional occurrences where a portable cushion can be used and carried on his/her person. Therefore, there currently exists a need in the industry for a portable, compact, mini cushion that immediately helps reduce the pain of a sway back for use on hard backed seating surfaces.

SUMMARY

The above and other needs are met by an apparatus a compact foam circular back support placed between the unsupported area of a sway back and a hard backed seating surface.

The device may further include one or more of: 1) a thermal or felt-like topping that would be included to put over one side of the cover against the sway back to also offer warmth according to conditions and individual's preference; 2) gel beads sewn into a lining to help absorb stringency; 3) removable and adjustable straps to help handicapped or wheelchair bound individuals to facilitate accessibility and flexibility.

Embodiments of the device disclosed herein are unique when compared to other known devices because 1) it provides portable, immediate, on the spot, comfort from the pain and pressure that is a direct result of the cavity exposed by a sway back on hard backed seating surfaces; 2) and it should also be noted that the enclosed device folds to a mini size and can be carried anywhere or anytime in a purse or pocket, and accessible for use by men and women.

The device disclosed herein is unique in that it is structurally different from other known devices or solutions.

More specifically, the device is unique due to the present of the following: 1) Velcro or hook and loop strips attached on one side of the cushion to adhere to hard backed seating surfaces which help keep the cushion in place and aid to alleviate the intensity and/or further motion of pain; 2) magnets that may be sewn into the top and bottom of the lining which magnetize through the cover and adhere to hard backed metal seating surfaces, which aid in holding the cushion in place and assist to dissipate any discomfort.

In a first aspect, a portable and foldable back support includes: a foam cushion; a cover shaped to tightly fit around the foam cushion, the cover including a front surface, a rear surface opposite the front surface, and a casing attached to the rear surface of the cover, the casing extending across a width of the rear surface and including a channel formed therethrough; an elongate string shaped to fit through and secured to the casing, the elongate string including opposing ends. In an unfolded configuration the string is untied, and the foam cushion is expanded within the cover. In a folded configuration the opposing ends of the string are tied together such that the the cover and encased foam cushion are folded.

In one embodiment, the cover further includes an opening formed at least partially around a side of the cover. In another embodiment, the cover further includes a closure mechanism along the opening for securing the opening in a closed position. In yet another embodiment, the closure mechanism is a hook and loop fastener.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
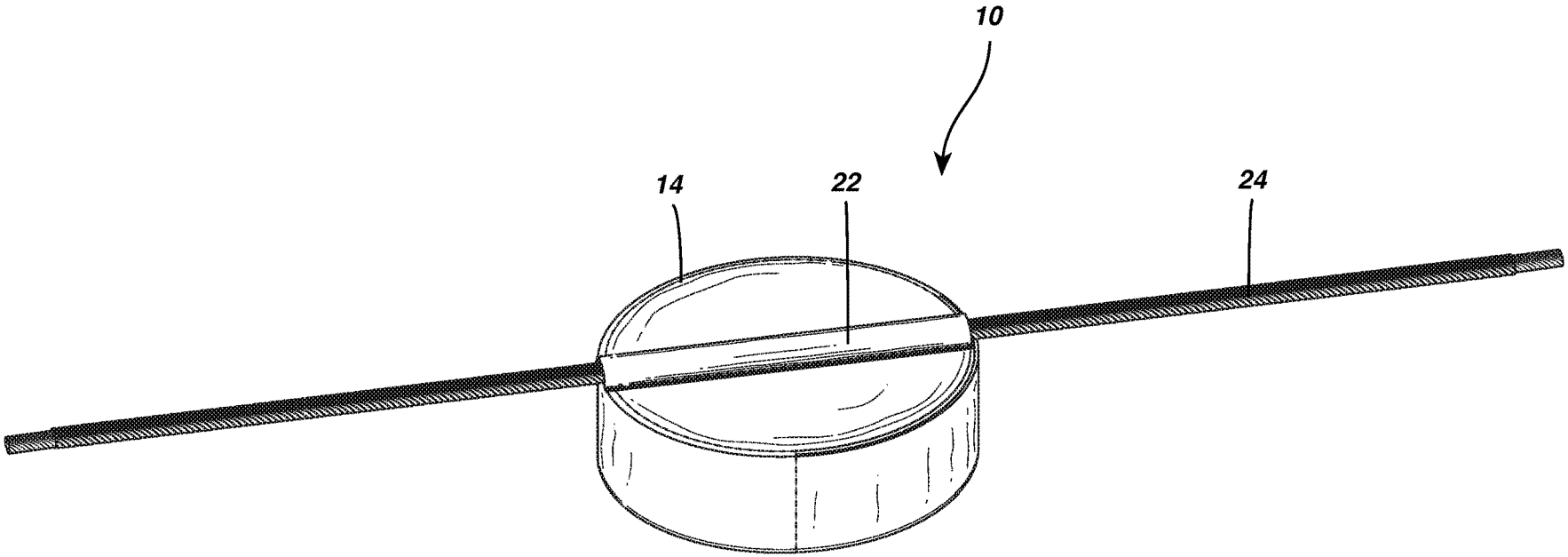
FIG. 1 shows a perspective view of a back support according to one embodiment of the present disclosure.
Figure 2:
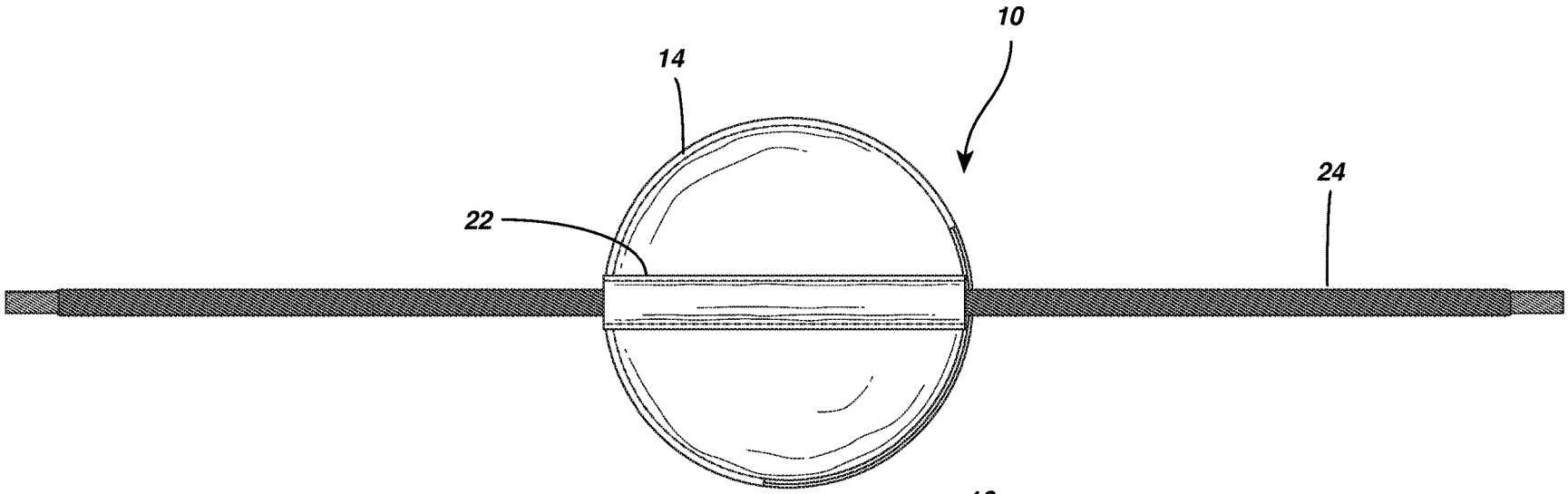
FIG. 2 shows a bottom view of a back support according to one embodiment of the present disclosure.
Figure 3:
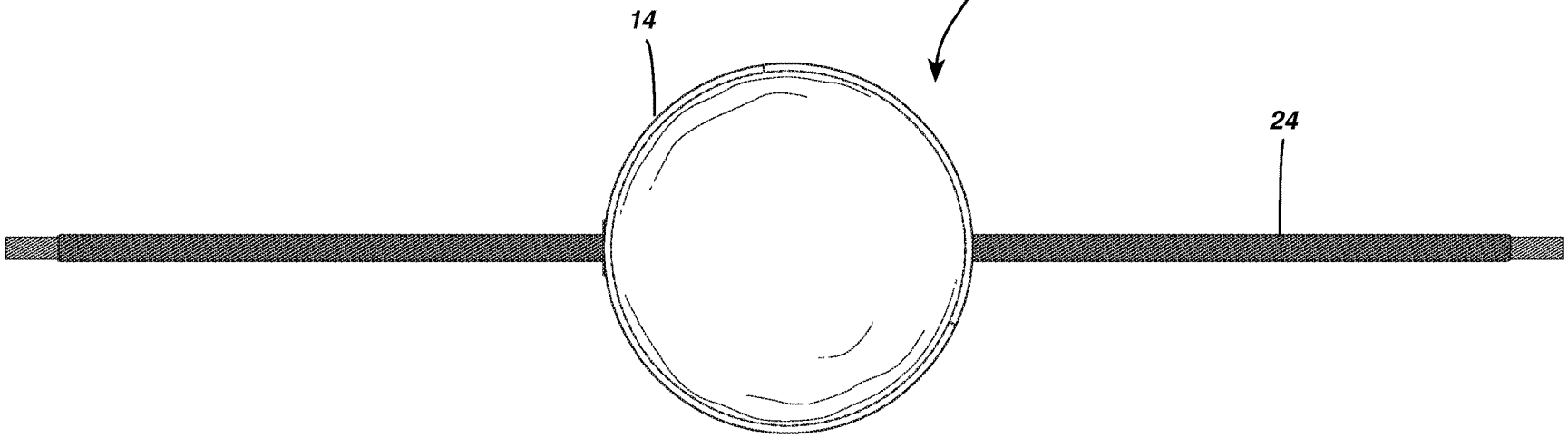
FIG. 3 shows a top view of a back support according to one embodiment of the present disclosure.
Figure 4:
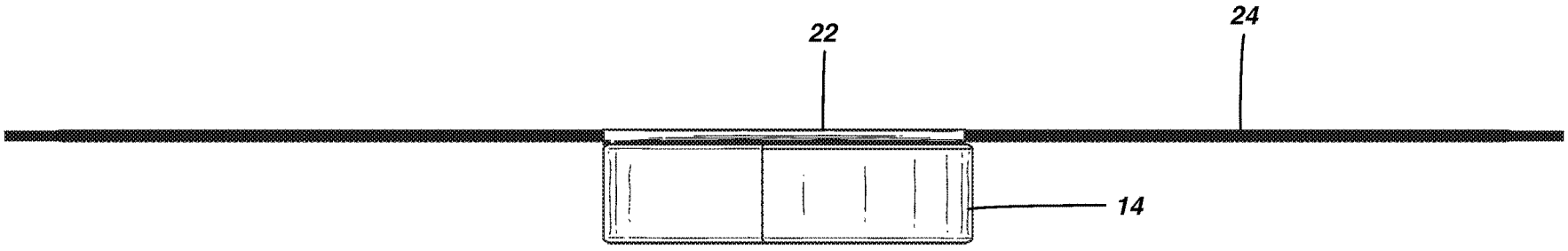
FIG. 4 shows a side view of a back support according to one embodiment of the present disclosure.
Figure 5:
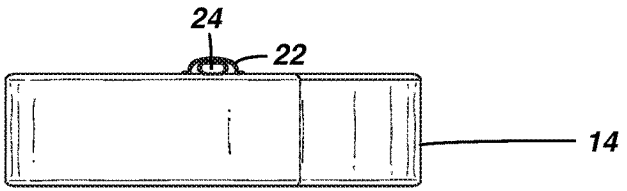
FIG. 5 shows a front view of a back support according to one embodiment of the present disclosure.

FIG. 1 shows a basic embodiment of a back support 10 for supporting a user's back when the user is in a seated position. The back support 10 includes a foam cushion 12 that is located within a cover 14. A string is secured to the cover 14 and is configured to be tied around the such that the back support is in a compacted or folded configuration when not in use. The back support 10 of the present disclosure advantageously provides a compact device that is easily transported or carried and readily deployed for use to support the user's back when in a seated position.

The foam cushion 12 is preferably circular in shape with upright sides such that the foam cushion 12 is substantially puck-shaped. The foam cushion 12 is preferably formed of a resilient foam material such that the foam cushion 12 is compressible between the user's back and a chair back during use while substantially returning to its original shape when not in use. The foam cushion 12 is compressible and may have varying degrees of firmness depending on user desired characteristics of the foam cushion 12.

The cover 14 preferably has a shaped such that the cover 14 tightly fits around an outer surface of the foam cushion 12. The cover 14 is preferably formed of a fabric material and may include embedded thermal properties such as gel beads or other thermal materials that would allow the cover 14 to be heated and retain heat during use. The cover 14 includes a front surface 18 and a rear surface 20 located opposite the front surface 18. A casing 22 is attached to the cover 14 preferably on the rear surface 20 of the cover 14. The casing 22 preferably extends substantially across a width of the rear surface 20 of the cover 14 and forms an opening for receiving a string or rope 24 therethrough. The casing 22 is preferably sewn on an outside of the cover 14, however it is also understood that the casing 22 may otherwise be located on the cover 14, such as integrally formed with the cover 14, for receiving the string 24 as described in greater detail below.

Figure 6:
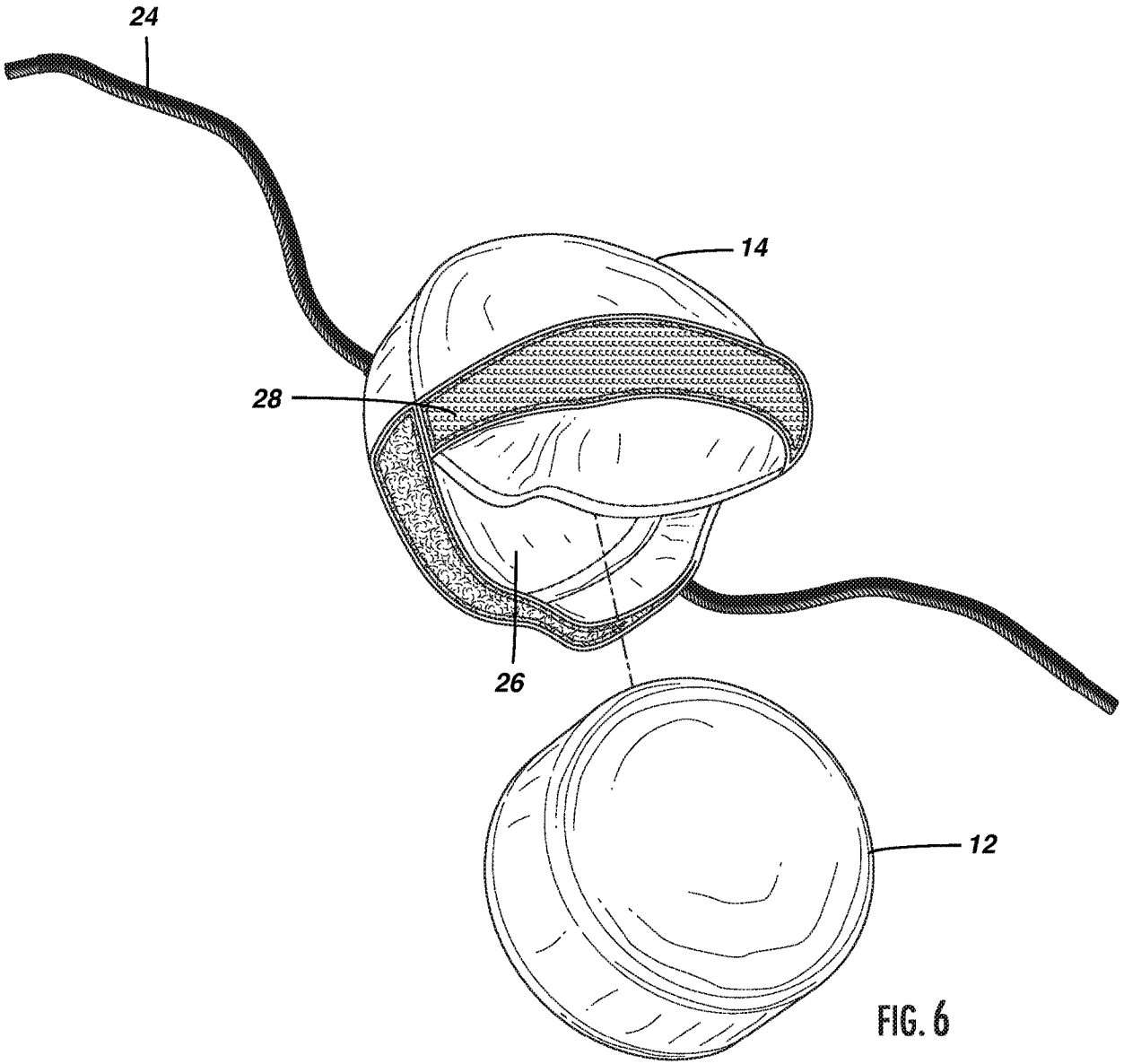
FIG. 6 shows an exploded view of a back support according to one embodiment of the present disclosure.

The cover 14 further preferably includes an opening 26 formed therein for inserting and removing the foam cushion 12 from within the cover 14. The opening 26 is preferably located along a side edge of the cover 14, such as along an upper side edge of the cover 14 as shown in FIG. 6. A closure mechanism 28 is positioned along the opening 26 to close the opening 26 and secure the foam cushion 12 within the cover 14. The closure mechanism 28 is preferably Velcro or a hook and loop fastener, but may alternatively include a zipper, snaps, or other suitable closure devices.

The string 24 is elongate and preferably has a width of approximately ⅜". A length of the string 24 may vary depending on a size of the foam cushion 12 and cover 14. In one embodiment, the string 24 has a length of approximately 15". A length of the string 24 is preferably such that ends of the string 24 may be tied together over rear surface 20 of the cover 14 and enclosed foam cushion 12 such that opposing ends of the string 24 may be tied together to fold the cover 14 and enclosed foam cushion 12. The string 24 is inserted through the casing 22 attached to the cover 14 and may be sewn or otherwise attached within the casing 22 to prevent the string 24 from becoming detached from the cover 14.

Figure 7:
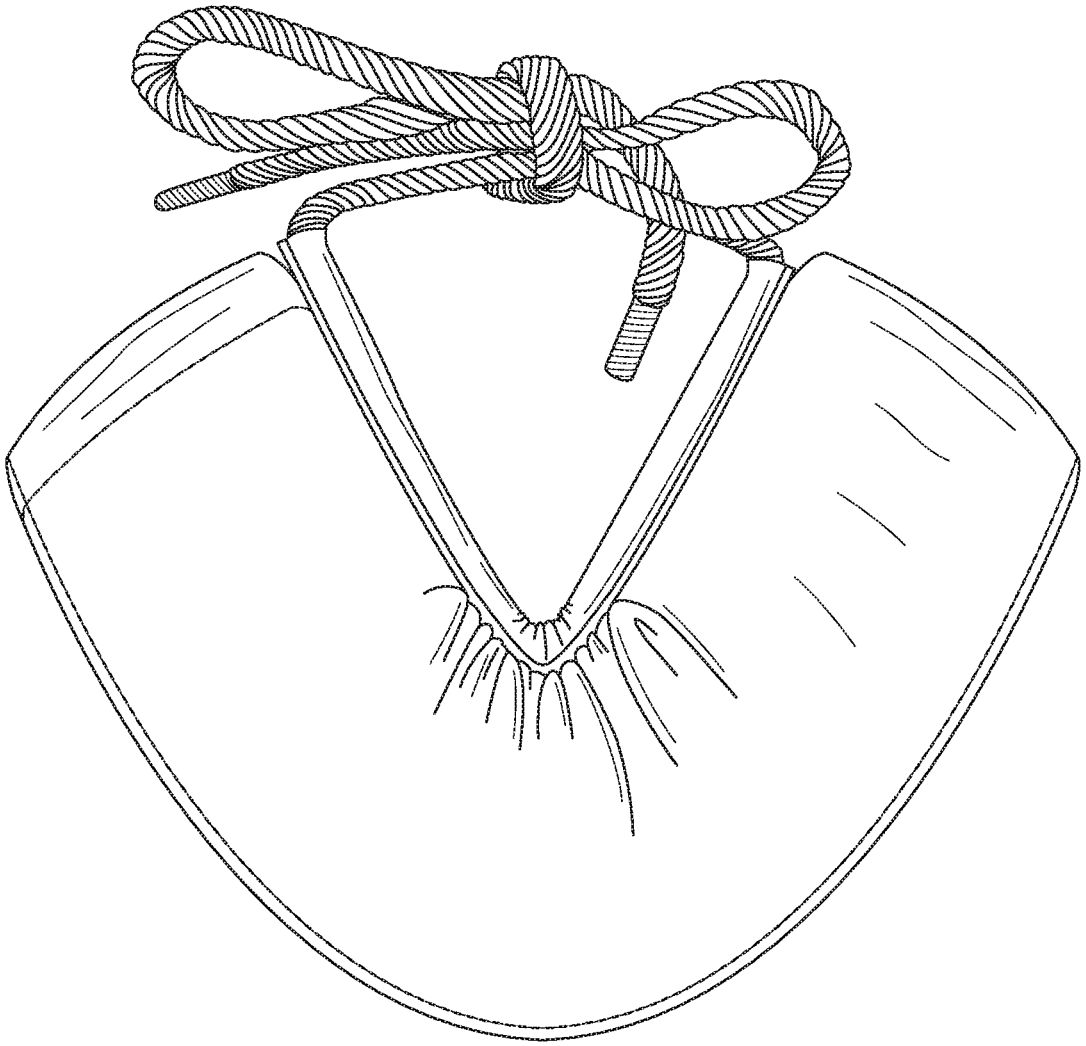
FIG. 7 shows a back support in a folded configuration according to one embodiment of the present disclosure.

The back support 10 is configured such that the back support 10 may be in an unfolded configuration for use and a folded configuration when the back support is not in use. In the unfolded configuration the string 24 is untied and the foam cushion 12 is fully expanded within the cover 14. In a folded configuration, ends of the string 24 are tied together such that ends of the casing 22 are pulled towards one another, thereby folding the cover 14 and enclosed foam cushion 12 as shown in FIG. 7. Ends of the string 24 are preferably tied such that opposing sides of the rear face of the cover 14 are pulled towards one another, thereby folding the back support 10.

In some embodiments, the back support 10 may include additional components for securing the back support 10 to a chair or other surface. In one embodiment, one or more magnets are embedded within the cover 14 to secure the back support to a metal seat back. In another embodiment, one or more fasteners such as hook and loop fasteners are formed on the cover 14 to secure the back support to a fabric seat back surface.

The back support of the present disclosure advantageously allows a user to carry the back support with them and readily deploy the back support for use on a wide range of seats or chairs.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A portable and foldable back support comprising:

a disc-shaped foam cushion;

a cover shaped to tightly fit around the foam cushion, the cover including a front surface, a rear surface opposite the front surface, and a casing attached to the rear surface of the cover, the casing extending across a diameter of the rear surface and including a channel formed therethrough, the casing including a first end located at a first side of the cover and a second end that is distal from the first end at a second side of the cover;

an elongate string shaped to fit within the casing, the elongate string including opposing ends;

wherein in an unfolded configuration the string is untied, and the disc-shaped foam cushion is expanded within the cover; and wherein in a folded configuration the opposing ends of the string are tied together such that the cover and enclosed disc-shaped foam cushion are folded such that the first end of the casing and the second end of the casing are drawn towards one another to fold the disc-shaped cushion about the diameter of the disc-shaped cushion.

2. The portable and foldable back support of claim 1, the cover further comprising an opening formed at least partially around a side of the cover.

3. The portable and foldable back support of claim 2, the cover further comprising a closure mechanism along the opening for securing the opening in a closed position.

4. The portable and foldable back support of claim 3, the closure mechanism comprising a hook and loop fastener.

* * * * *